United States Patent [19]

Hambrick et al.

[11] 3,974,597

[45] Aug. 17, 1976

[54] RAIL BASE GRINDING METHOD

[76] Inventors: Lester N. Hambrick, 121 Woodland Drive, Irving, Tex. 77009; Carl C. Flowers, 2872 Alden Ave., Dallas, Tex. 75211

[22] Filed: Apr. 25, 1975

[21] Appl. No.: 571,692

Related U.S. Application Data

[60] Division of Ser. No. 376,882, June 29, 1973, Pat. No. 3,908,317, which is a continuation of Ser. No. 169,986, Aug. 9, 1971, abandoned.

[52] U.S. Cl. ..... 51/281 R; 51/178

[51] Int. Cl.[2] ..... B24B 1/00

[58] Field of Search ..... 51/178, 281 A, 241 LG, 51/241 S, 111 R

[56] References Cited

UNITED STATES PATENTS 3,205,623 9/1965 Clayborne et al. ..... 51/178

*Primary Examiner*—James L. Jones, Jr.

*Attorney, Agent, or Firm*—Richards, Harris and Medlock

[57] ABSTRACT

A rail base grinding apparatus comprises a self-powered vehicle adapted for movement along a trackway to the location of a welded joint formed between two rails in the trackway. A pantograph linkage extends from one side of the vehicle and supports a lead screw which in turn supports a grinding mechanism. The pantograph linkage serves to manipulate the grinding mechanism between an elevated transportation position and an operating position and to maintain alignment between the grinding mechanism and the plane of the rails of the trackway. The lead screw is employed to control the vertical positioning of the grinding mechanism both prior to and during operation of the grinding mechanism to remove the base portion of the welding flash of the welded joint.

11 Claims, 4 Drawing Figures

FIG. 1
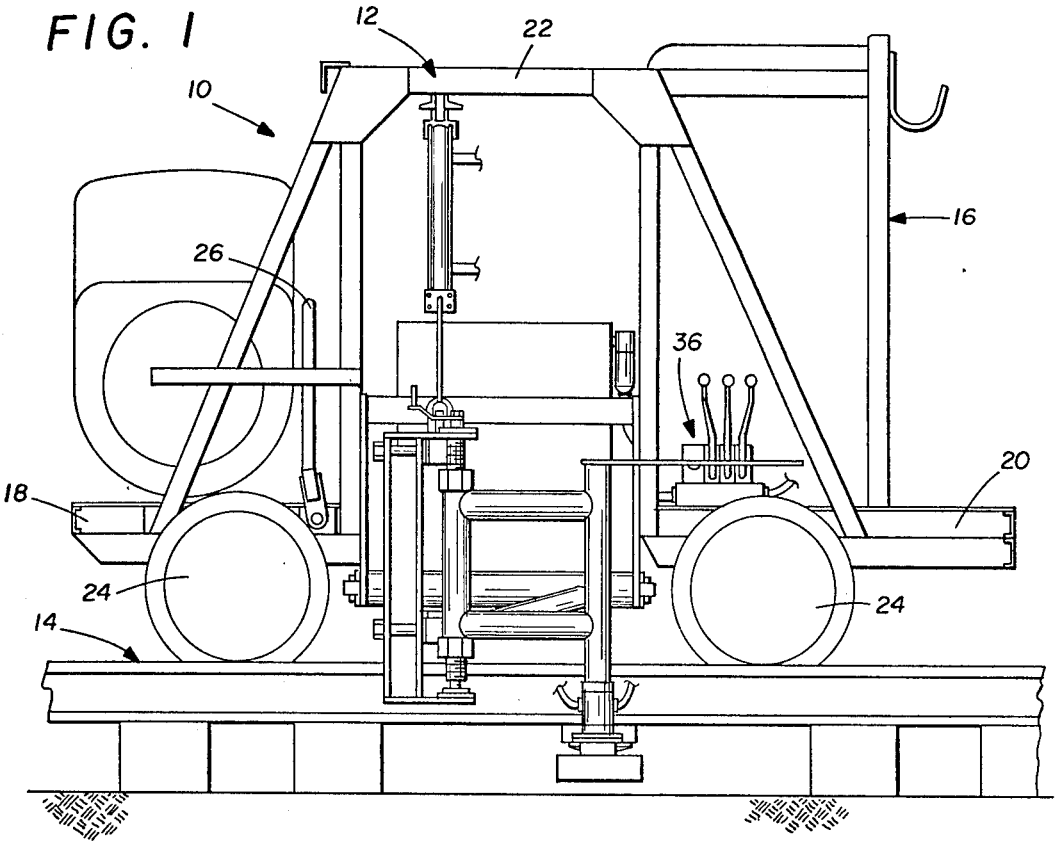
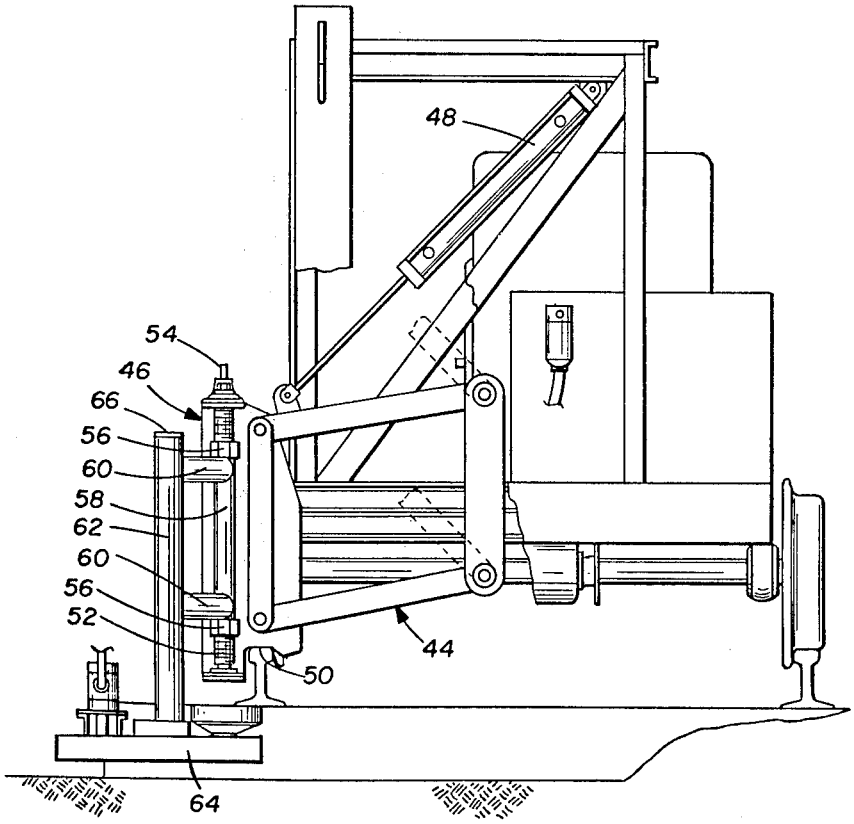
FIG. 2

RAIL BASE GRINDING METHOD

This is a division of application Ser. No. 376,882, filed June 29, 1973, now U.S. Pat. No. 3,908,317, which is a continuation of application Ser. No. 169,986, filed Aug. 9, 1971, now abandoned.

BACKGROUND AND SUMMARY OF THE INVENTION

This invention relates to a rail base grinding apparatus, and more particularly to a rail base grinding apparatus that is particularly useful in track welding operations.

The co-pending application of John F. Bryan, Jr., filed May 16, 1970, Ser. No. 55,470, relates to a track welding system for interconnecting rails in railroad tracks and similar trackways. In the practice of the Bryan invention, existing bolted joints between the rails of a trackway are removed after which the adjacent ends of the rails are joined by oxyacetylene welding. The welding operation produces welding flash which must be removed before the trackway can be returned to service.

The present invention comprises a rail base grinding apparatus useful in the practice of the Bryan invention to remove welding flash from the base portion of a welded joint. In accordance with the preferred embodiment of the invention, a grinding mechanism is mounted on a self-propelled vehicle for movement along a trackway to the location of a welded joint. Apparatus is provided for aligning the welding mechanism with the bottom surfaces of the rails and for engaging the grinding mechanism with welding flash of the welded joint that protrudes below the bottom surfaces of the rails. The welding mechanism is preferably of minimal overall height so that the flash can be removed without disturbing the tie base of the trackway.

DESCRIPTION OF THE DRAWINGS

A more complete understanding of the invention may be had by referring to the following Detailed Description when taken in conjunction with the accompanying Drawings, wherein:

FIG. 1 is a side view of a rail base grinding apparatus incorporating the invention;

FIG. 2 is an end view of the rail base grinding apparatus shown in FIG. 1 in which certain parts have been broken away more clearly to illustrate certain features of the invention;

DETAILED DESCRIPTION

Figure 3:
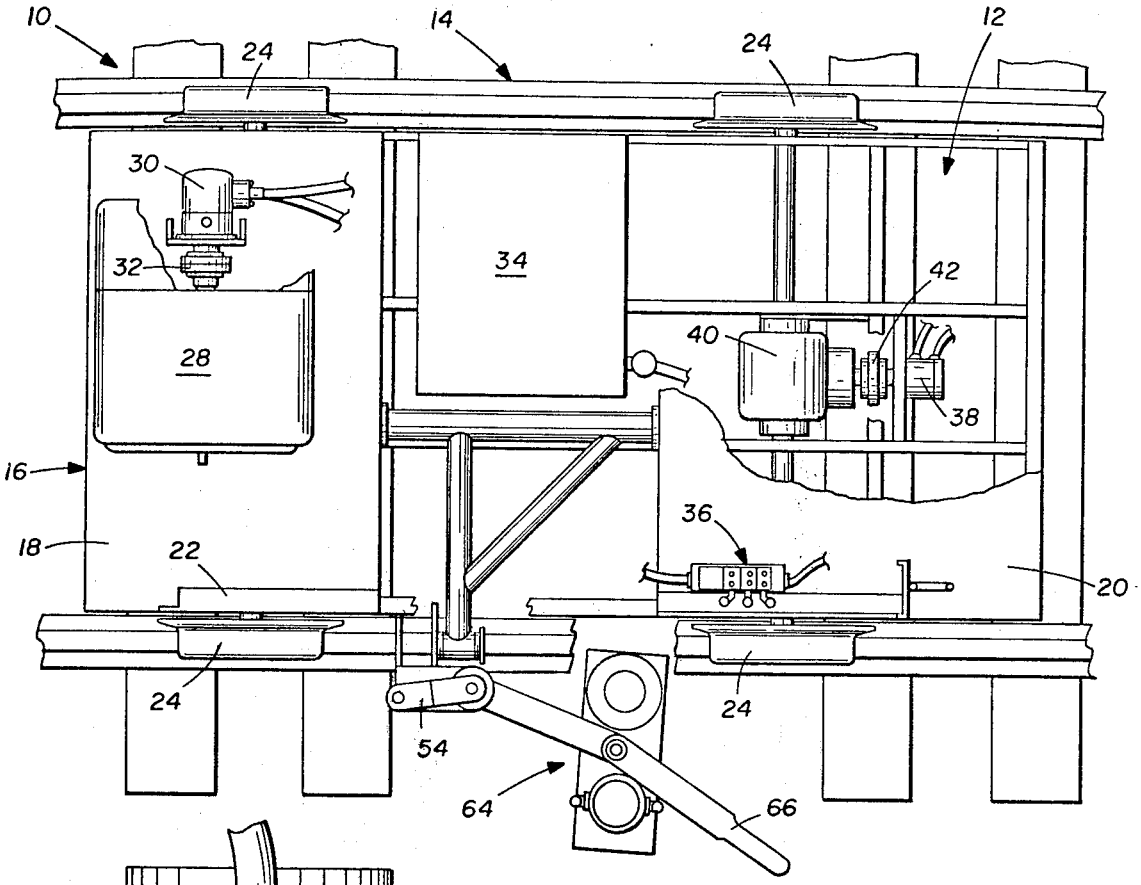
FIG. 3 is a top view of the rail base grinding apparatus in which certain parts have been broken away.

Referring now to the Drawings, and particularly to FIG. 1 thereof, there is shown a rail base grinding apparatus 10 incorporating the present invention. The apparatus 10 comprises a vehicle 12 adapted for movement along a trackway 14 to a position over a welded joint between a pair of adjacent rails in the trackway. The vehicle 12 includes a frame 16 comprising a pair of end portions 18 and 20 and a superstructure 22 which extends between the end portions 18 and 20. The frame 16 is supported on the trackway 14 by four flanged wheels 24. A brake lever 26 is provided for actuating conventional brake assemblies to prevent rotation of the wheels 24 relative to the frame 16 and thereby arrest movement of the vehicle 12 along the trackway 14.

As is best shown in FIG. 3, an engine 28 is supported on the end portion 18 of the frame 16. The engine 28 drives a hydraulic pump 30 through a flexible coupling 32. The pump 30 functions to withdraw hydraulic fluid from a sump 34 and to supply pressurized hydraulic fluid to a valve assembly 36. The valve assembly comprises three manually operable valves which function to control the flow of hydraulic fluid from the pump 30 to the various operating instrumentalities of the rail base grinding apparatus 10. For example, one of the valves of the valve assembly 36 is operable to direct hydraulic fluid to a hydraulic motor 38 which is connected to a differential 40 through a flexible coupling 42. The differential 40 is in turn coupled to two of the flanged wheels 24, so that upon operation of the engine 28 and the appropriate valve of the valve assembly 36, the motor 38 propels the vehicle 12 along the trackway 14.

Referring now to FIG. 2, the rail base grinding apparatus 10 further includes a pantograph linkage 44 which is connected between the frame 16 and a subframe 46. A hydraulic cylinder 48 is connected between the frame 16 and the pantograph linkage 44 and is operable under control of one of the valves of the valve assembly 36 to manipulate the subframe 46 between the operating position shown in FIG. 2 and an elevated transportation position which is indicated by dashed lines. The subframe 46 includes a locating surface 50 which engages a rail of the trackway 14 to assure proper positioning of the subframe 46 when the hydraulic cylinder 48 is actuated to manipulate the subframe to the operating position.

A lead screw 52 is supported on the subframe 46 for rotation under the action of a handle 54. A pair of nuts 56 are threadably engaged with the lead screw 52, and a tube 58 is supported on the lead screw 52 by the nuts 56. A pair of arms 60 extend horizontally from the tube 58 and function to support a vertically extending column 62. A grinding mechanism 64 is supported on the column 62 for rotation with respect thereto under the action of a handle 66.

Figure 4:
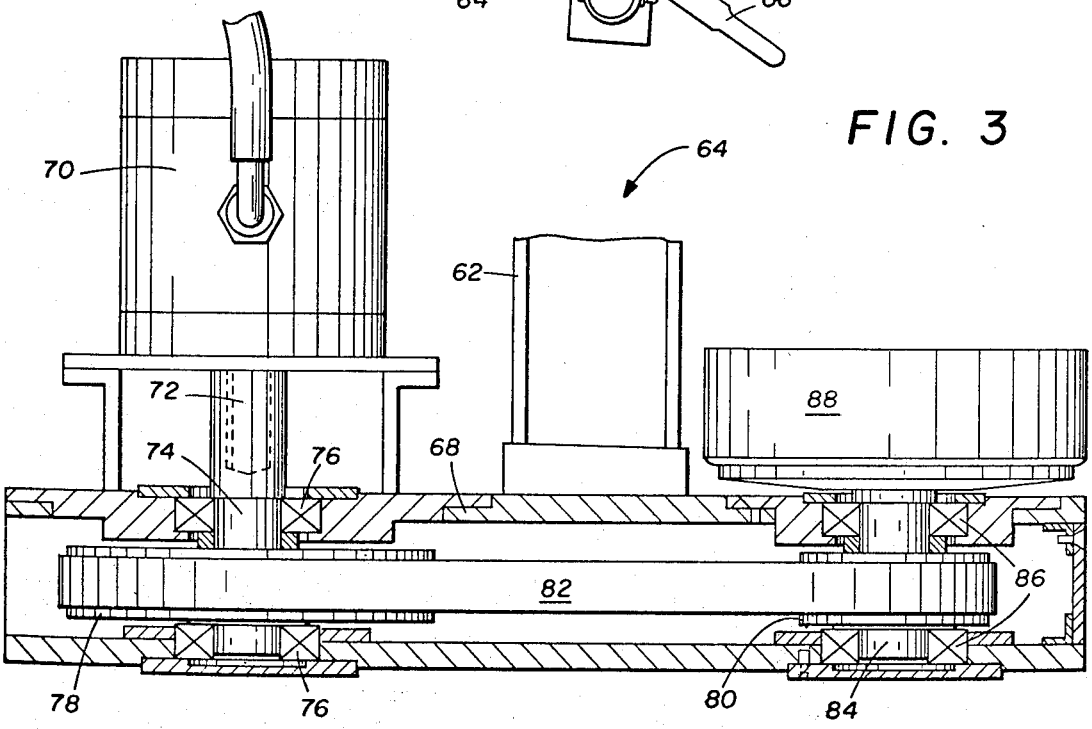
FIG. 4 is a sectional view of the grinding mechanism of the rail base grinding apparatus shown in FIG. 1.

Referring now to FIG. 4, the grinding mechanism 64 comprises a housing 68 which is supported by the column 62 and a hydraulic motor 70 which is mounted on the housing 68. The motor 70 operates under the control of one of the valves of the valve assembly 36 to rotate an output shaft 72. The shaft 72 is keyed to a shaft 74 which is supported in the housing 68 by a pair of bearings 76 and which in turn supports a sprocket 78.

The sprocket 78 of the grinding mechanism 64 is operatively coupled to a sprocket 80 by a toothed belt 82. The sprocket 80 is mounted on a shaft 84 which is supported in the housing 68 by a pair of bearings 86 and which in turn supports a grinding wheel 88. Thus, upon operation of the motor 70, the grinding wheel 88 is rotated relative to the housing 68.

OPERATION

The present invention is preferably employed to remove welding flash that results from the use of the above-identified invention of John F. Bryan, Jr., to form welded joints between the rails of a trackway. Initially, the hydraulic cylinder 48 is operated to raise the subframe 46 and the grinding mechanism 64 to the transportation position, and the motor 38 is actuated to position the vehicle 12 over a welded joint between adjacent rails in a trackway. When the vehicle 12 is properly positioned, the brake lever 26 is actuated to set the brakes of the vehicle, and the hydraulic cylinder 48 is actuated to lower the subframe 46 until the locating surface 50 thereof engages the upper surface of a rail in the trackway.

When the subframe 46 is in the operating position, the handle 54 is manipulated to position the grinding wheels 88 for engagement with flash which protrudes from the base portion of the welded joint beneath the bottom surfaces of the rails. Then, the motor 70 is actuated to rotate the grinding wheel and the handle 66 is manipulated to move the grinding wheel 88 into engagement with the welding flash. By this means, the flash is removed until the bottom surface of the welded joint is aligned with the bottom surfaces of the adjacent rails that are interconnected by the joint. It will be appreciated that in many instances it will be necessary to manipulate the handle 54 to adjust the vertical positioning of the grinding wheel 88 during the use of the grinding mechanism 64 to remove the welding flash.

When the grinding of the base portion of a particular welded joint has been completed, the operation of the motor 70 is discontinued and the handle 66 is manipulated to remove the grinding wheel 88 from beneath the rails of the trackway. Then, the hydraulic cylinder 48 is actuated to raise the subframe 46 to the transportation position. Finally, the motor 38 is actuated to propel the vehicle 12 along the trackway until the vehicle 12 is aligned with the next welded joint therein. Thereafter, the foregoing steps are repeated to finish the base portion of the welded joint.

The mechanism illustrated in the Drawings incorporates several structural features which are highly advantageous in a rail base grinding apparatus. For example, when a welded joint is formed between adjacent rails in a trackway, it is necessary to remove the ties from the trackway in order to provide access to the adjacent ends of the rails. On the other hand, it is desirable that the tie base of the trackway remain undisturbed so that it is not necessary to tamp or otherwise prepare the tie base prior to the replacement of the ties of the trackway. To this end, the total vertical height of the grinding wheel 88 and the housing 68 of the grinding mechanism 64 does not exceed the height of a standard tie, i.e., 5 ½ inches. This permits manipulation of the grinding wheel 88 under the rails of a trackway without disturbing the tie base of the trackway.

The use of the pantograph linkage 44 to support the subframe 46 of the rail base grinding apparatus 10 is also highly advantageous. This is because, due to the nature of a pantograph linkage, the angular relationship between the subframe 46 and the plane of the rails of the trackway remains constant, notwithstanding variations in the heights of the rails, etc. By this means, once the upper surface of the grinding wheel 88 of the grinding mechanism 64 is aligned with the bottom surfaces of the rails of the trackway, it remains in alignment therewith even though the hydraulic cylinder 48 is repeatedly operated to manipulate the subframe 46 between the operating position and the transportation position.

Still another advantageous structural characteristic of the rail base grinding apparatus shown in the Drawings is the use of the lead screw 52 to support the grinding mechanism 64. By this means, the vertical positioning of the grinding mechanism is readily and accurately controlled, both during the initial positioning of the grinding wheel 88 and during the grinding operation itself.

Yet another important structural feature of the present invention comprises the use of hydraulic actuators to drive the various operating instrumentalities of the device. This is advantageous in that only one power source is required and in that the usual complicated mechanical transmissions are completely eliminated.

From the foregoing, it will be understood that the present invention comprises a rail base grinding apparatus including a self-powered vehicle for movement along a trackway, a grinding mechanism, and structure connected between the vehicle and the grinding mechanism for engaging the grinding mechanism with the base portion of a welded joint between two rails of the trackway. Preferably, the grinding mechanism supporting structure is adapted both to align the grinding mechanism with the bottom surfaces of the rails and to permit adjustment of the vertical positioning of the grinding mechanism during grinding operations. Also, the grinding mechanism preferably has a minimal overall height so that it is unnecessary to disturb the tie base of the trackway during grinding operations.

Although the preferred embodiment of the invention has been illustrated in the accompanying Drawings and described in the foregoing specification, it will be understood that the invention is not limited to the embodiment disclosed, but is capable of rearrangement, modification, and substitution of parts and elements without departing from the spirit of the invention.

What is claimed is:

1. In a process for welding the rails of a trackway comprising metal rails supported by metal tie plates on wooden ties which are in turn supported on a ballast roadbed of the type wherein a tie is first moved laterally relative to the roadbed to expose the adjacent end of a pair of rails comprising the trackway, and a welded joint is subsequently formed between the adjacent ends of the rails, the improvement comprising:

manipulating a grinding apparatus having an upper grinding surface in the space between the bottom surfaces of the joined rails and the upper surface of the ballast of the roadbed that was previously occupied by the tie and thereby removing weld flashing projecting below the bottom surfaces of the rails;

subsequently repositioning the tie between the bottom surfaces and the roadbed;

both of the foregoing steps being carried out without disturbing the ballast of the roadbed and thereby facilitating the return of the trackway to service.

2. The improvement according to claim 1 wherein the step of manipulating the grinding apparatus is further characterized by manipulating the upper surface thereof in a plane extending parallel to the bottom surfaces of the joined rails.

3. The improvement according to claim 2 wherein the step of manipulating the grinding apparatus is further characterized by initially positioning the upper surface of the grinding apparatus in a horizontal plane extending parallel to the under surfaces of the joined rails, and subsequently manipulating the upper grinding surface of the grinding apparatus in said horizontal plane to engage the upper grinding surface with weld flashing projecting beneath the bottom surfaces of the joined rails.

4. A rail grinding process comprising:

moving a tie of a trackway laterally to provide an open space between the bottom surface of at least one rail of the trackway and the ballast of the roadbed of the trackway;

manipulating a grinding apparatus having an upper grinding surface in the open space between the bottom surface of the rail and the ballast that was previously occupied by the tie and thereby removing material projecting beneath the bottom surface of the rail; and subsequently returning the tie to its original position between the bottom surface of the rail and the ballast of the roadbed.

5. The rail grinding process according to claim 4 wherein the grinding apparatus is manipulated to engage the upper grinding surface thereof with weld flashing projecting beneath the bottom surfaces of a pair of rails, the adjacent ends of which are joined by a welded joint.

6. The rail grinding process according to claim 5 wherein the step of manipulating the grinding apparatus is carried out while maintaining the upper grinding surface thereof in a horizontal plane extending parallel to the bottom surfaces of the joined rails.

7. The rail grinding process according to claim 6 wherein the grinding apparatus manipulating step is further characterized by initially positioning the grinding apparatus with the upper grinding surface thereof positioned in the horizontal plane and subsequently manipulating the grinding apparatus in the open space between the bottom surfaces of the rails and the ballast of the roadbed to engage the upper grinding surface with the weld flashing.

8. A rail grinding process comprising:

moving a tie of a trackway laterally to provide an open space between the bottom surfaces of the rails of the trackway and the ballast of the roadbed of the trackway;

positioning adjacent ends of two rails comprising the trackway above the open space provided by the lateral movement of the tie;

forming a welded joint between the adjacent ends of the rails;

manipulating a grinding apparatus in the open space between the bottom surfaces of the joined rails and the ballast of the roadbed which was previously occupied by the tie and thereby removing welding flash which extends beneath the bottom surfaces of the rails; and subsequently returning the tie to its original position between the surfaces of the rails and the ballast of the roadbed.

9. The rail grinding process according to claim 8 wherein the grinding apparatus has an upper grinding surface and wherein the grinding apparatus manipulating step is further characterized by engaging the upper grinding surface of the grinding apparatus with weld flashing extending beneath the bottom surfaces of the joined rails.

10. The rail grinding process according to claim 9 wherein the grinding apparatus manipulating step is further characterized by moving the upper grinding surface of the grinding apparatus in a horizontal plane extending parallel to the bottom surfaces of the rails.

11. The rail grinding process according to claim 10 wherein the step of manipulating the grinding apparatus is further characterized by initially aligning the upper grinding surface of the grinding apparatus with said horizontal plane and subsequently manipulating the grinding apparatus while maintaining the upper grinding surface thereof in said horizontal plane.

* * * * *